US011819991B2

(12) United States Patent
Chien et al.

(10) Patent No.: US 11,819,991 B2
(45) Date of Patent: Nov. 21, 2023

(54) RETAINING DEVICE FOR USE WITH A NAIL GUN

(71) Applicant: BASSO INDUSTRY CORP., Taichung (TW)

(72) Inventors: Chia-Yu Chien, Taichung (TW); Ching-Han Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 17/456,267

(22) Filed: Nov. 23, 2021

(65) Prior Publication Data

US 2022/0161405 A1 May 26, 2022

(30) Foreign Application Priority Data

Nov. 25, 2020 (TW) ..... 109141327

(51) Int. Cl.
*B25C 1/06* (2006.01)

(52) U.S. Cl.
CPC ..... *B25C 1/06* (2013.01)

(58) Field of Classification Search
CPC ..... B25C 1/06
See application file for complete search history.

(56) References Cited

U.S. PATENT DOCUMENTS

| | | | | |
|---|---|---|---|---|
| 2012/0067934 | A1* | 3/2012 | Li | B25C 1/06 227/8 |
| 2014/0076952 | A1* | 3/2014 | Garber | B25C 1/06 227/129 |
| 2018/0200873 | A1* | 7/2018 | Chien | B25C 1/06 |
| 2020/0246952 | A1* | 8/2020 | Chien | B25D 11/02 |

FOREIGN PATENT DOCUMENTS

| | | | |
|---|---|---|---|
| EP | 2644323 | | 10/2013 |
| JP | 2020082302 | A | 6/2020 |
| TW | 202027931 | A | 8/2020 |
| TW | 202030060 | A | 8/2020 |

OTHER PUBLICATIONS

Search Report issued in corresponding EP Application 21210048.1, dated May 11, 2022, 8 pages.
Search Report appended to an Office Action, which was issued to Taiwanese counterpart application No. 109141327 by the TIPO dated Jul. 7, 2021, with an English translation thereof.

* cited by examiner

*Primary Examiner* — Thomas M Wittenschlaeger
*Assistant Examiner* — Katie L Gerth
(74) *Attorney, Agent, or Firm* — Burris Law, PLLC

(57) ABSTRACT

A retaining device adapted for use with an electric nail gun includes a retaining member; a swing arm unit adapted to swing between a proximate position and a distal position with respect to a flywheel of the nail gun; an impact unit movably connected to the swing arm unit, including an engaging portion, and being movable between a pre-striking position, where the engaging portion is confined within the retaining member when the swing arm unit is at the distal position, and a striking position, where the engaging portion is removed from the retaining member; and a retrieving unit connected between the impact unit and the swing arm unit, and configured to bias the impact unit to move to the pre-striking position.

8 Claims, 6 Drawing Sheets

RETAINING DEVICE FOR USE WITH A NAIL GUN

CROSS-REFERENCE TO RELATED APPLICATION

This application claims priority of Taiwanese Patent Application No. 109141327, filed on Nov. 25, 2020.

FIELD

The disclosure relates to an electric nail gun, and more particularly to a retaining device for use with an electric nail gun having a flywheel.

BACKGROUND

A conventional electric nail gun disclosed in Japanese Patent Publication No. 2020082302 includes a flywheel that is rotatable by electric power, a driver that is configured to be driven by rotation of the flywheel to strike a nail, a returning mechanism that moves the driver to its original position after the striking, and a stopping mechanism that restricts movement of the driver after the driver returns to the original position. During a nail-striking process, the stopping member is disengaged from the driver, so that the driver can be pushed by a pushing member to contact a pressure roller. The pressure roller then pushes the driver to contact the flywheel to perform the striking operation.

When the nail-striking process is completed and the driver is moved to its original position by the returning mechanism, movement of the driver is restricted by the stopping mechanism such that the driver is prevented from being accidentally driven to strike the nail. However, the stopping mechanism of the conventional electric nail gun has a rather complex configuration, which makes it difficult for installation and maintenance.

SUMMARY

Therefore, the object of the disclosure is to provide a retaining device for use with an electric nail gun that has a simpler structure for installation and maintenance.

According to the disclosure, a retaining device is adapted for use with a nail gun. The nail gun includes a frame, and a flywheel that is rotatably mounted to the frame. The retaining device includes a retaining member, a swing arm unit, an impact unit and a retrieving unit.

The retaining member is adapted to be connected to the frame, and has a stopping end portion. The swing arm unit is adapted to be pivoted to the frame, and is adapted to swing relative to the frame between a proximate position, where the swing arm unit is proximate to the flywheel, and a distal position, where the swing arm unit is distal from the flywheel. The impact unit is movably connected to the swing arm unit, is adapted to swing together with the swing arm unit relative to the frame, includes an engaging portion, and is movable in a striking direction, and a retrieving direction opposite to the striking direction between a pre-striking position, where the engaging portion of the impact unit is confined within the retaining member when the swing arm unit is at the distal position, so as to prohibit removal of the impact unit from the pre-striking position, and a striking position, where the engaging portion of the impact unit is far away from the retaining member, such that, rotation of the swing arm unit from the distal position to the proximate position results in removal of the engaging portion of the impact unit from the retaining member, after which the swing arm unit comes into contact with the flywheel, so as to allow the impact unit to be driven by the flywheel to move away from the retaining member and from the pre-striking position to the striking position.

The retrieving unit is connected between the impact unit and the swing arm unit, and is configured to bias the impact unit to move in the retrieving direction to the pre-striking position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
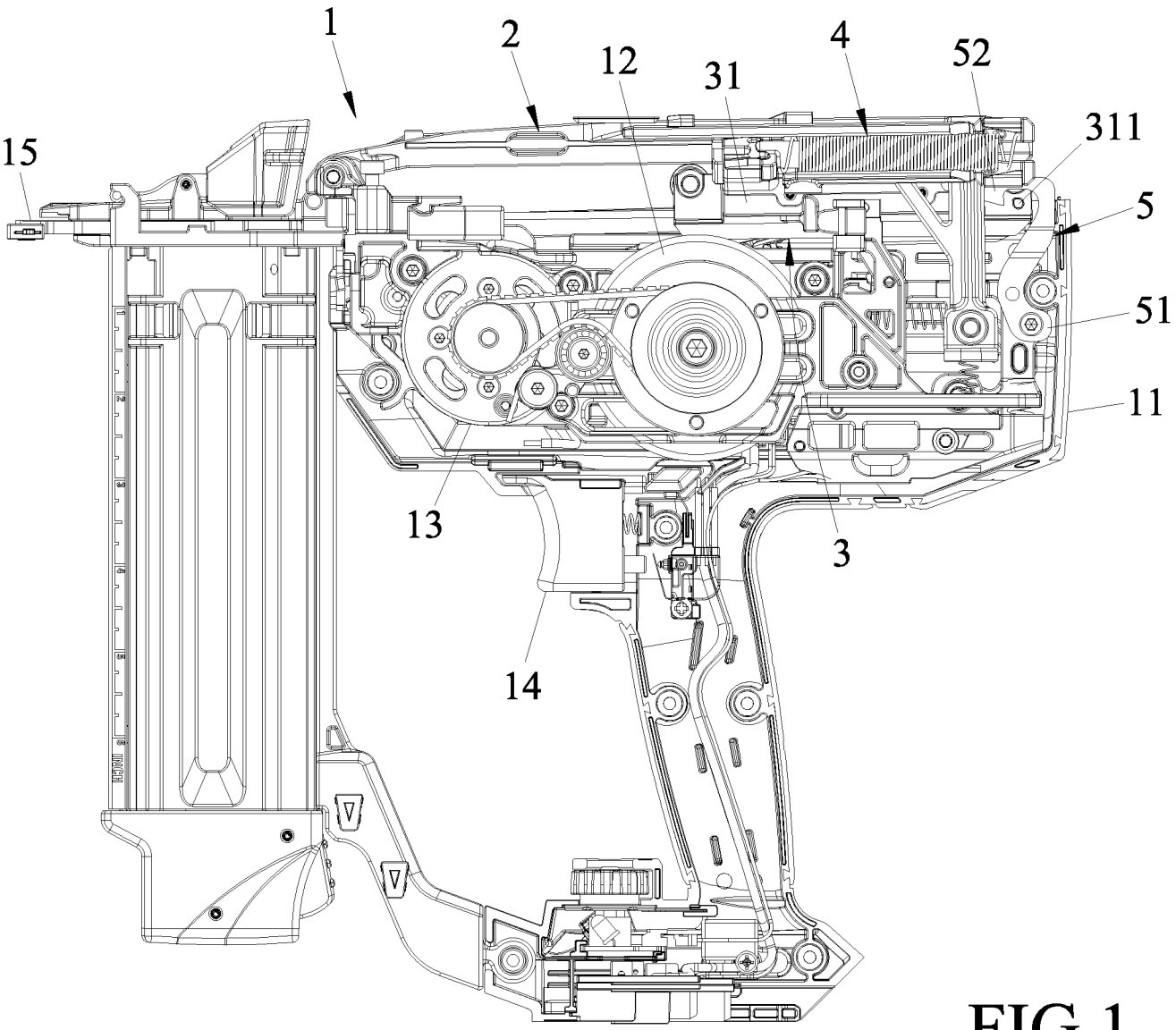
FIG. 1 is a schematic side view illustrating an embodiment of a retaining device according to the disclosure being mounted in a nail gun.
Figure 2:
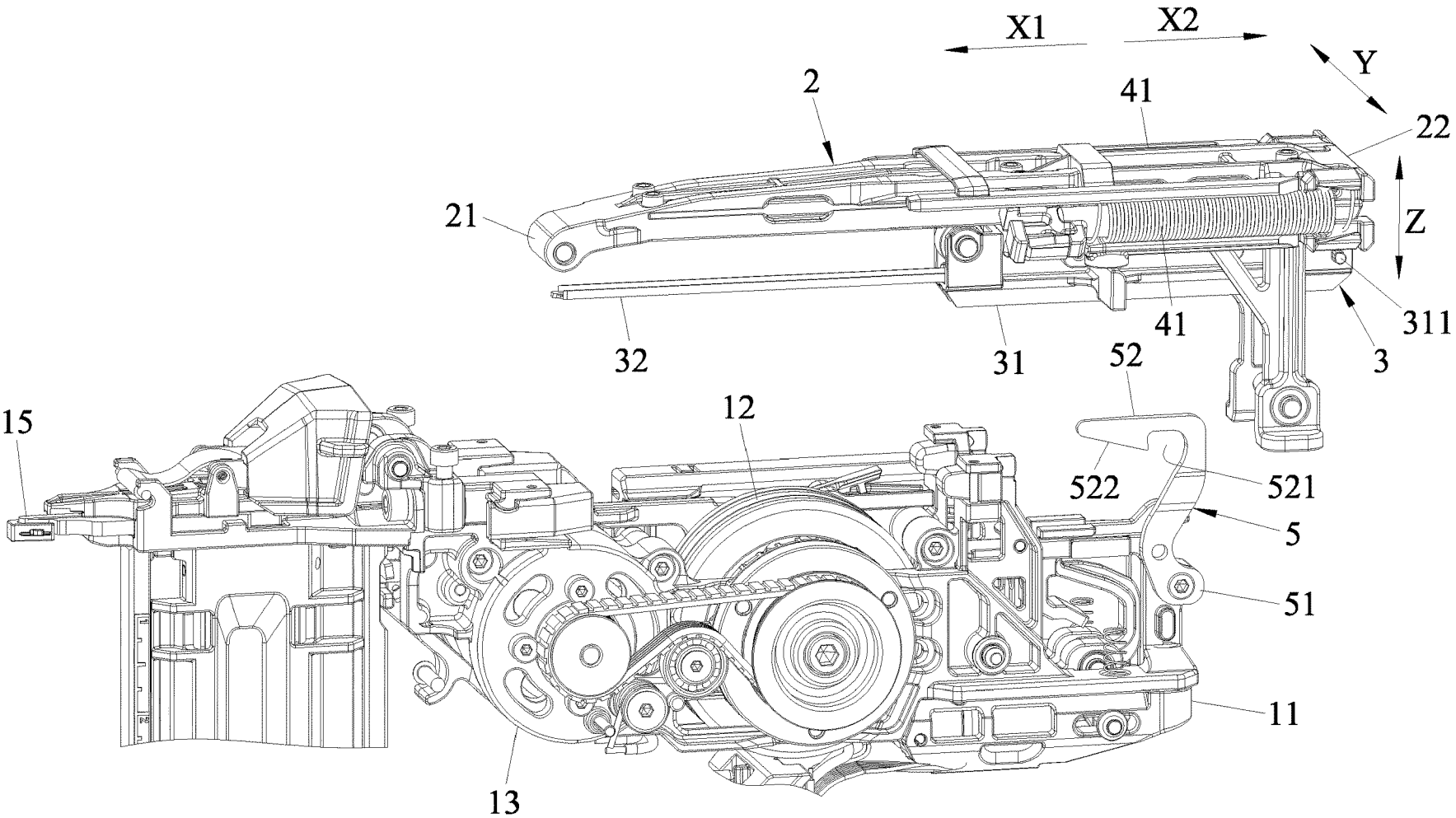
FIG. 2 is a fragmentary and partially exploded perspective view of the nail gun and the embodiment.

Referring to FIGS. 1 and 2, an embodiment of a retaining device according to the disclosure is adapted for use in a flywheel electric nail gun 1. The nail gun 1 includes a frame 11, a flywheel 12 that is rotatably mounted to the frame 11, a motor unit 13 that drives the flywheel 12 to rotate by electric power, and a trigger unit 14 and a safety unit 15 that are movably installed on the frame 11 for manual operation. The trigger unit 14 and the safety unit 15 are configured to determine whether the motor unit 13 is activated and whether to perform a nail-striking action. The retaining device includes a swing arm unit 2, an impact unit 3, a retrieving unit 4, and a retaining member 5.

The swing arm unit 2 extends along a striking direction (X1) and is adapted to be spaced apart from the flywheel 12 along a swinging direction (Z) that is substantially perpendicular to the striking direction (X1). The swing arm unit 2 includes a pivot portion 21 that is adapted to be pivoted to the frame 11, and a swinging portion 22 that is opposite to the pivot portion 21. The swinging portion 22 of the swing arm unit 2 is adapted to be operated by the trigger unit 14 to swing along the swinging direction (Z) relative to the flywheel 12 between a distal position (see FIG. 3), where the swinging portion 22 is distal from the flywheel 12, and a proximate position (see FIG. 4 and FIG. 5), where the swinging portion 22 is proximate to the flywheel 12.

The impact unit 3 is movably connected to the swing arm unit 2, and is adapted to swing together with the swing arm unit 2 relative to the frame 11. The impact unit 3 includes an impact member 31 that is movably connected to the swing arm unit 2, and a striking rod 32 that is co-movably connected to the impact member 31 and that is adapted for striking a nail (not shown). In the present embodiment, the impact member 31 has an engaging portion 311 that is configured as a cylinder protruding in a transverse direction (Y) that is perpendicular to the swinging direction (Z) and the striking direction (X1) from one side of the impact member 31.

The impact unit 3 is movable in the striking direction (X1) and a retrieving direction (X2) opposite to the striking direction (X1) between a pre-striking position (see FIG. 1 and FIG. 3), where the impact member 31 of the impact unit 3 is proximate to the swinging portion 22 of the swing arm unit 2, and a striking position (see FIG. 6), where the impact member 31 is proximate to the pivot portion 21 of the swing arm unit 2.

The retrieving unit 4 includes two resilient members 41 that are connected to the impact member 31 of the impact unit 3 and the swing arm unit 2, and that are spaced apart from each other along the transverse direction (Y). The resilient members 41 are configured to bias the impact unit 3 to move in the retrieving direction (X2) to the pre-striking position. It should be noted that the number of the resilient members 41 is not limited to two. In variations of the embodiment, the number of the resilient member 41 may be one or more than two.

The retaining member 5 extends generally along the swinging direction (Z), and includes a connecting end portion 51 that is adapted to be connected to the frame 11, and a stopping end portion 52 that is opposite to the connecting end portion 51. The stopping end portion 52 defines a receiving slot 521 that is adapted to be open toward the frame 11 along the swinging direction (Z), and has a inclined guide surface 522 that is adapted to be spaced apart from the frame 11 along the swinging direction (Z). The inclined guide surface 522 has two ends that are opposite to each other in a direction inclined relative to the striking direction (X1). One of the ends of the inclined guide surface 522 is adapted to be closer to both the frame 11 and the receiving slot 521 than the other one of the ends.

When the impact unit 3 is at the pre-striking position and when the swing arm unit 2 is at the distal position, the engaging portion 311 of the impact unit 3 is confined within the receiving slot 521 of the retaining member 5, so as to prohibit removal of the impact unit 3 from the pre-striking position. When the impact unit 3 is at the striking position, the engaging portion 311 of the impact unit 3 is far away from the retaining member 5, such that, rotation of the swing arm unit 2 from the distal position to the proximate position results in removal of the engaging portion 311 of the impact unit 3 from the retaining member 5, after which the swing arm unit 2 comes into contact with the flywheel 12, so as to allow the impact unit 3 to be driven by the flywheel 12 move away from the retaining member 5 and from the pre-striking position to the striking position.

Figure 3:
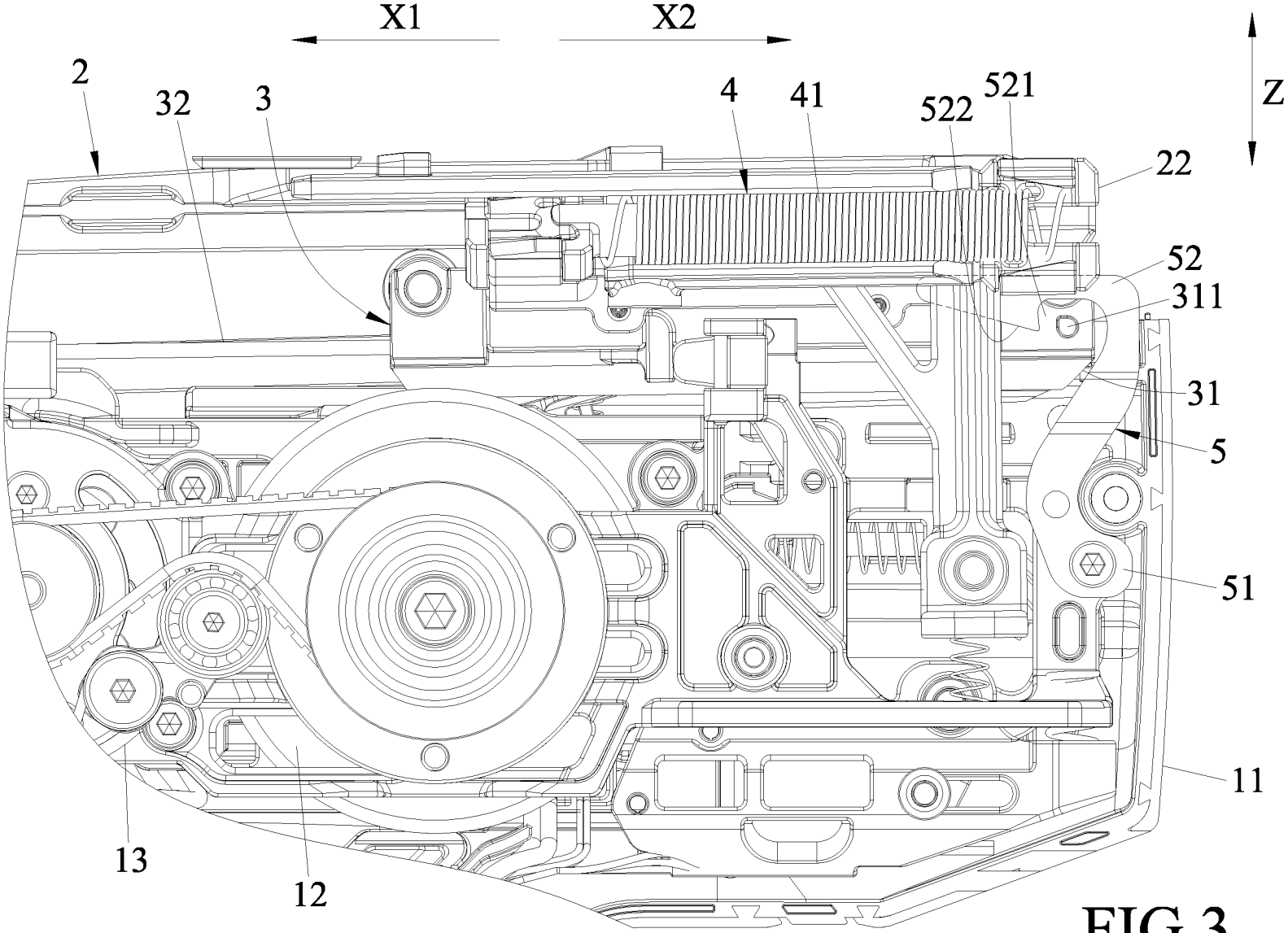
FIG. 3 is a fragmentary schematic side view of the nail gun and the embodiment, illustrating a swing arm unit being at a distal position, and an impact unit being at a pre-striking position.

Referring to FIG. 3, prior to an operation of the nail gun 1, the swing arm unit 2 is at the distal position (i.e., the swinging portion 22 of the swing arm unit 2 is distal from the flywheel 12), the impact unit 3 is at the pre-striking position (i.e., the impact member 31 is spaced apart from the flywheel 12), and the engaging portion 311 of the impact member 31 is confined in the receiving slot 521 of the retaining member 5.

Figure 4:
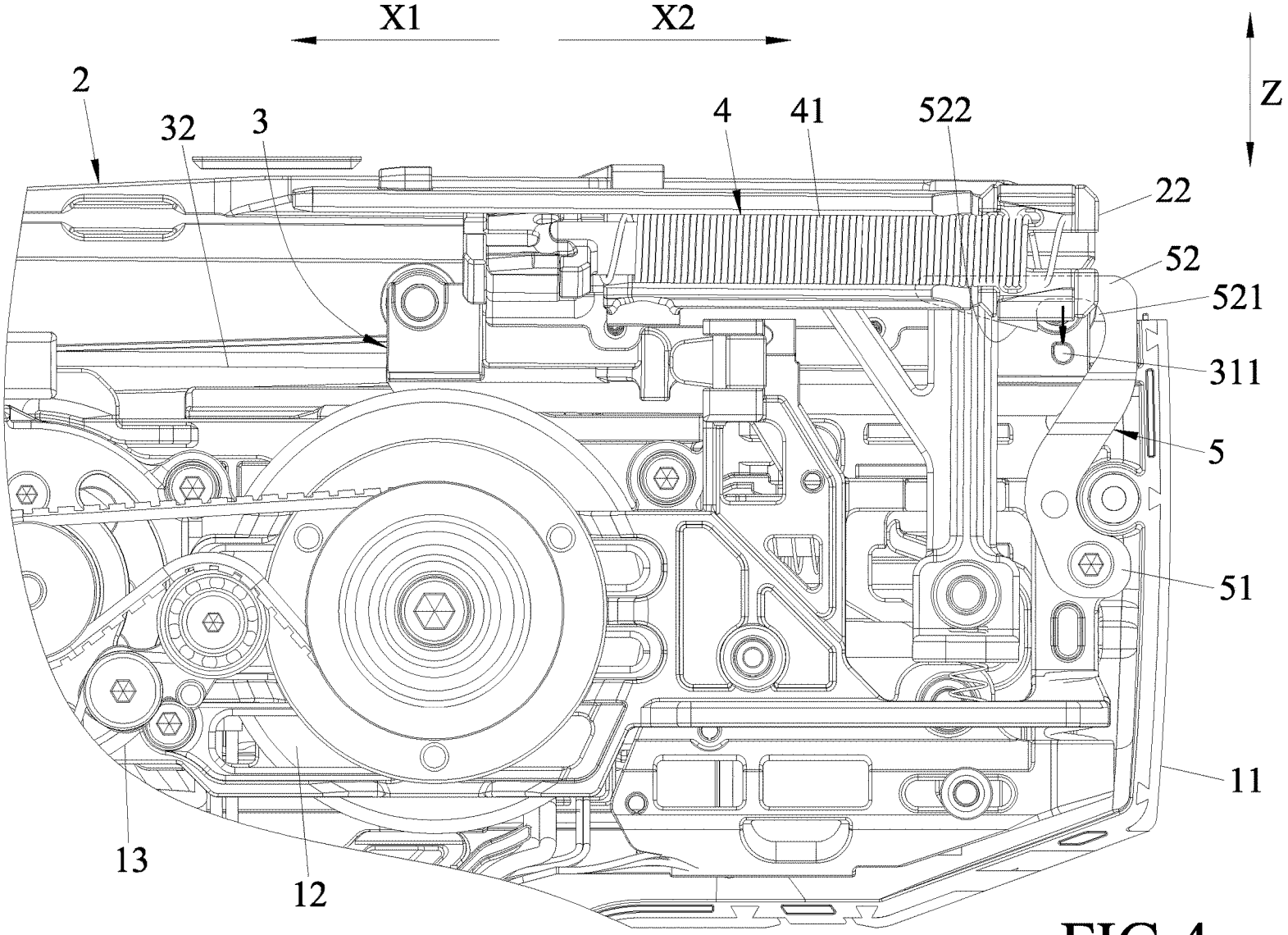
FIG. 4 is a view similar to FIG. 3, but illustrating the swing arm unit being at a proximate position.
Figure 5:
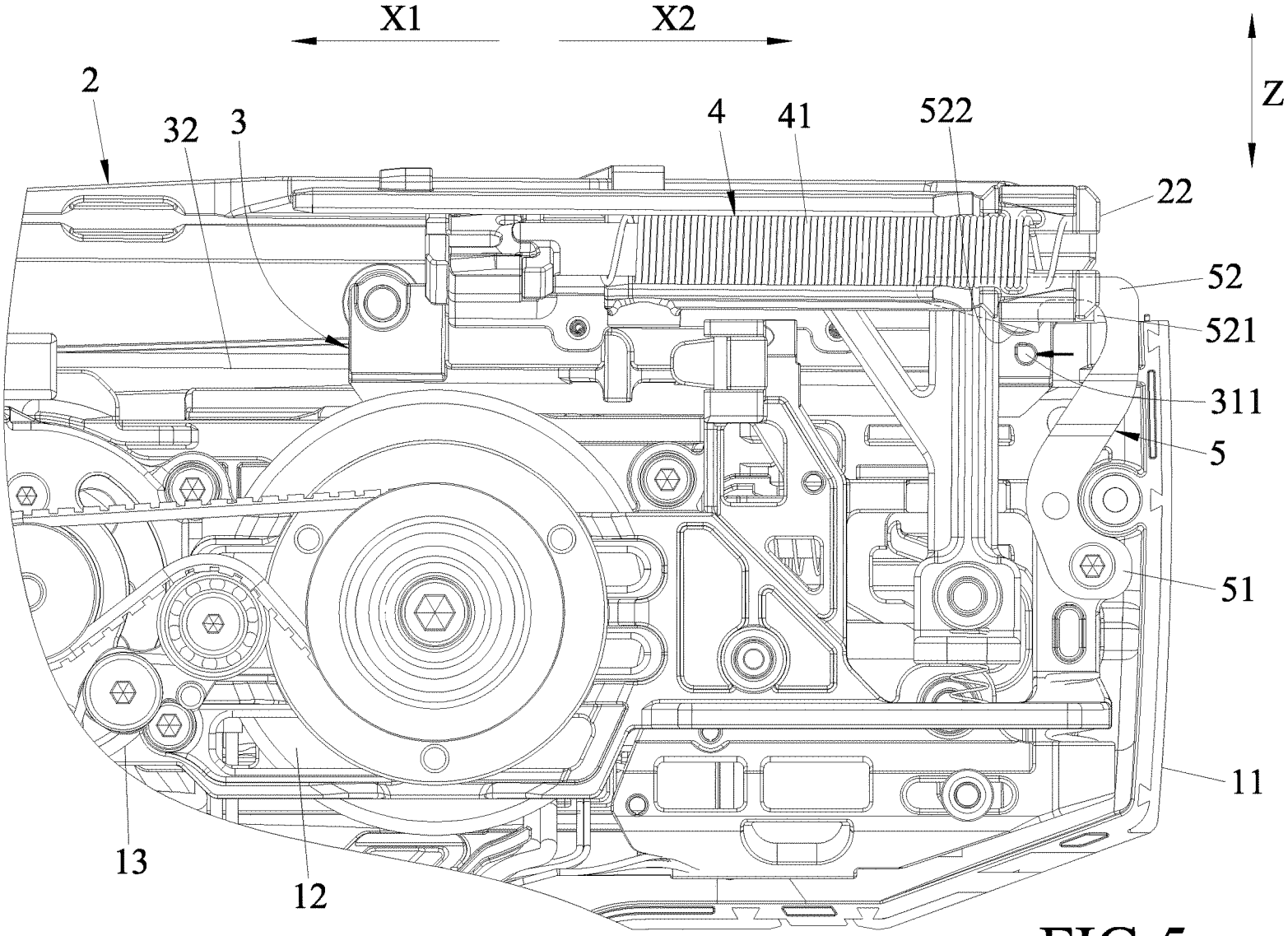
FIG. 5 is a view similar to FIG. 4, but illustrating the impact unit being removed from the pre-striking position.
Figure 6:
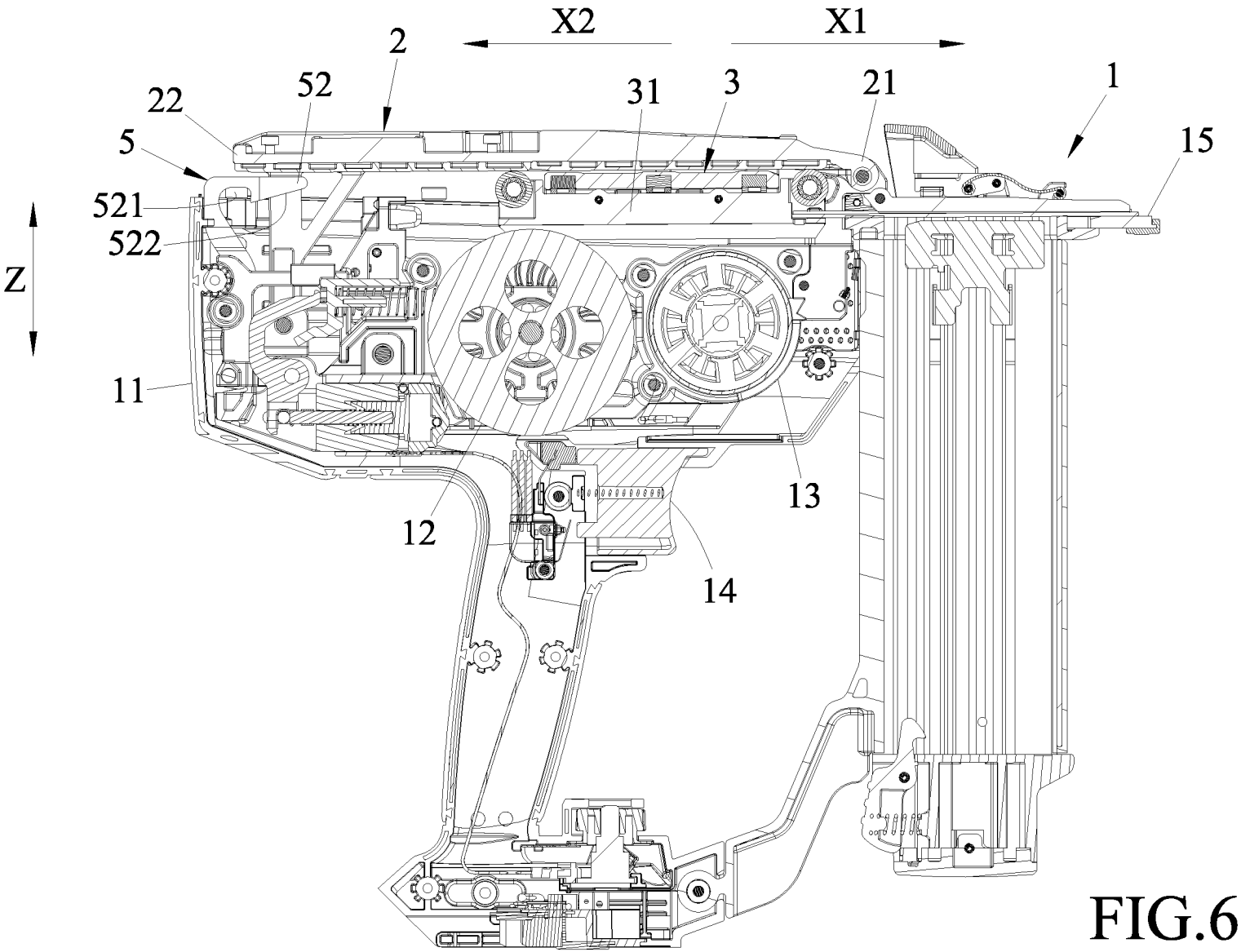
FIG. 6 is a schematic side view of the embodiment and the nail gun, illustrating the impact unit being at a striking position.

Referring to FIG. 4 and FIG. 5, during the operation, when the flywheel 12 starts to rotate to a predetermined speed, a user may operate the trigger unit 14 to enter a single-striking mode, or operate both the trigger unit 14 and the safety unit 15 in order to enter a sequential-striking mode. Then, the swing arm unit 2 is driven to swing toward the flywheel 12 to the proximate position and bring the impact member 31 at the pre-striking position toward the flywheel 12. As a result, the engaging portion 311 of the impact member 31 is removed from the receiving slot 521 of the retaining member 5 and is no longer confined by the retaining member 5. When the impact member 31 is brought into contact with the flywheel 12, as shown in FIG. 6, the impact unit 3 is urged by the rotation of the flywheel 12 to move in the striking direction (X1) from the pre-striking position toward the striking position. After the striking rod 32 of impact unit 3 strikes the nail (not shown), as shown in FIG. 1, the impact unit 3 is subjected to the biasing force of the resilient members 41 to move in the retrieving direction (X2) from the striking position toward the pre-striking position.

Specifically, referring to FIG. 3, when the impact unit 3 is driven by the resilient member 41 to move toward the pre-striking position, the engaging portion 311 on the impact member 31 is brought into contact with the inclined guide surface 522 of the retaining member 5 and is guided by the inclined guide surface 522 to move toward the receiving slot 521 of the retaining member 5. At the same time, the swing arm unit 2 moves away from the flywheel 12 (i.e., toward the distal position) and brings the engaging portion 311 into the receiving slot 521. At this point, the engaging portion 311 is again confined in the receiving slot 521 and is prohibited from moving in the striking direction (X1). That is, once the impact unit 3 returns to the pre-striking position, it remains confined by the stopping end portion 52 of the retaining member 5 until the next time the swing arm unit 2 is driven to swing toward the proximate position.

In sum, the present embodiment of the retaining device for use in the nail gun has benefits as follows. By virtue of the presence of the retaining member 5 and the engagement between the receiving slot 521 of the retaining member 5 and the engaging portion 311 of the impact member 31, the impact member 31 is prevented from accidentally striking the nail after returning from the striking position to the pre-striking position. In addition, compared with the prior art, the retaining device of the present disclosure is able to provide the same function with a simpler structure, which is easier for installation and maintenance.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A retaining device adapted for use with a nail gun, the nail gun including a frame, and a flywheel that is rotatably mounted to the frame, said retaining device comprising:

a retaining member that is adapted to be connected to the frame, and that has a stopping end portion;

a swing arm unit that is adapted to be pivoted to the frame, and that is adapted to swing relative to the frame between a proximate position, where said swing arm unit is proximate to said flywheel, and a distal position, where said swing arm unit is distal from the flywheel;

an impact unit that is movably connected to said swing arm unit, that is adapted to swing together with said swing arm unit relative to the frame, that includes an engaging portion, and that is movable in a striking direction, and a retrieving direction opposite to the striking direction between a pre-striking position, where said engaging portion of said impact unit is confined within said retaining member when said swing arm unit is at the distal position, so as to prohibit removal of said impact unit from the pre-striking position, and a striking position, where said engaging portion of said impact unit is far away from said retaining member, such that, rotation of said swing arm unit from the distal position to the proximate position results in removal of said engaging portion of said impact unit from said retaining member, after which said impact unit comes into contact with the flywheel, so as to allow said impact unit to be driven by said flywheel to move away from said retaining member and from the pre-striking position to the striking position; and a retrieving unit connected between said impact unit and said swing arm unit, and configured to bias said impact unit to move in the retrieving direction to the pre-striking position.

2. The retaining device as claimed in claim 1, wherein said retaining member further has a connecting end portion that is opposite to said stopping end portion, and that is adapted to be connected to the frame.

3. The retaining device as claimed in claim 1, wherein said stopping end portion of said retaining member defines a receiving slot such that, when said impact unit is at the pre-striking position and when said swing arm unit is distal from the flywheel, said engaging portion of said impact unit is confined within said receiving slot of said retaining member.

4. The retaining device as claimed in claim 1, wherein said swing arm unit is adapted to swing in a swinging direction relative to the frame, the swinging direction being transverse to the striking direction, said receiving slot of said retaining member being adapted to be open toward the frame along the swinging direction.

5. The retaining device as claimed in claim 4, wherein said engaging portion of said impact unit protrudes in a transverse direction perpendicular to the swinging direction and the striking direction.

6. The retaining device as claimed in claim 5, wherein said retrieving unit includes at least one resilient member that is connected to said impact unit and said swing arm unit.

7. The retaining device as claimed in claim 6, wherein said retrieving unit includes two of said resilient members, said resilient members being spaced apart from each other along the transverse direction.

8. The retaining device as claimed in claim 1, wherein said stopping end portion of said retaining member has an inclined guide surface that is adapted to be spaced apart from the frame along the swinging direction, and that has two ends being opposite to each other in a direction inclined relative to the striking direction, one of said ends being adapted to be closer to both the frame and said receiving slot than the other one of said ends.

* * * * *